US005171950A

United States Patent [19]

Brauner et al.

[11] Patent Number: 5,171,950

[45] Date of Patent: Dec. 15, 1992

[54] FLEXIBLE POUCH AND PAPER BAG COMBINATION FOR USE IN THE MICROWAVE POPPING OF POPCORN

[75] Inventors: Arne H. Brauner, Minnetonka, Minn.; Charles A. Davis, Lake Wylie, S.C.

[73] Assignee: General Mills, Inc., Minneapolis, Minn.

[21] Appl. No.: 405,813

[22] Filed: Sep. 11, 1989

[51] Int. Cl.[5] ..... H05B 6/80

[52] U.S. Cl. ..... 219/10.55 E; 219/10.55 F; 426/107; 426/113; 426/234; 99/DIG. 14

[58] Field of Search ..... 219/10.55 E, 10.55 F; 426/107, 113, 115, 118, 234, 243, 111; 99/DIG. 14

[56] References Cited

U.S. PATENT DOCUMENTS

| | | | |
|---|---|---|---|
| 3,389,783 | 6/1968 | Bjorkengren . | |
| 4,210,674 | 7/1980 | Mitchell | 219/10.55 E |
| 4,358,466 | 11/1982 | Stevenson | 426/118 |
| 4,448,309 | 5/1984 | Roccaforte et al. . | |
| 4,453,665 | 6/1984 | Roccaforte et al. . | |
| 4,553,010 | 11/1985 | Bohrer et al. . | |
| 4,586,649 | 5/1986 | Webinger . | |
| 4,596,713 | 6/1986 | Burdette . | |
| 4,640,838 | 2/1987 | Isakson et al. | 426/107 |
| 4,678,882 | 7/1987 | Bohrer et al. . | |
| 4,691,374 | 9/1987 | Watkins et al. . | |
| 4,734,288 | 3/1988 | Engstrom et al. . | |
| 4,735,513 | 4/1988 | Watkins et al. . | |
| 4,777,053 | 10/1988 | Tobelmann et al. | 219/10.55 E |
| 4,801,774 | 1/1989 | Hart | 219/10.55 E |
| 4,810,844 | 3/1989 | Anderson | 219/10.55 E |
| 4,857,342 | 8/1989 | Kappes | 219/10.55 E |
| 4,866,232 | 9/1989 | Stone | 219/10.55 E |
| 4,890,439 | 1/1990 | Smart . | |

FOREIGN PATENT DOCUMENTS 8809754 12/1988 PCT Int'l Appl. .

*Primary Examiner*—Philip H. Leung

*Attorney, Agent, or Firm*—L. MeRoy Lillehaugen; John A. O'Toole

[57] ABSTRACT

The self-opening flexible pouch for use in a microwave oven includes a thin plastic film laminated to a paper substrate. The lower portion of the pouch in use is provided with a relatively large susceptor component and the upper portion of the pouch is provided with a relatively small susceptor component. The relatively large susceptor component causes the popcorn kernels contained in the pouch to pop and the relatively small susceptor component causes the pouch to open and allow at least some of the popped popcorn to be released into a paper bag in which the pouch and its contents have been placed. Two methods are disclosed for fabricating the pouch.

16 Claims, 8 Drawing Sheets

FLEXIBLE POUCH AND PAPER BAG COMBINATION FOR USE IN THE MICROWAVE POPPING OF POPCORN

BACKGROUND OF THE INVENTION

1. Field of the Invention

This invention relates generally to the packaging of popcorn kernels for popping in a microwave oven, and pertains more specifically to a package which includes a flexible pouch that opens at the proper moment to release at least some of the popped corn into an enclosing paper bag in which the pouch has been placed.

2. Description of the Prior Art

The prior art is replete with various packaging arrangements designed to be placed in a microwave oven in order to develop a desired degree of browning and crisping of the packaged food. Some of the prior packages are intended to be in the form of a flexible bag. Actually, U.S. Pat. No. 4,735,513, granted to James D. Watkins et al on Apr. 5, 1988 for "Flexible Packaging Sheets" suggests various packaging forms, including a flexible bag. A bag made in accordance with the teachings of the alluded to patent does not possess a self-opening capability. Also, the bag, as well as other forms of packaging illustrated in said patent, are relatively costly to fabricate.

International application No. PCT/AU88/00179 filed on Jun. 7, 1988 and published on Dec. 15, 1988 titled "Microwave Interactive Package" discloses a polyester plastic film having a microwave interactive metallic layer deposited over its entire surface, the interactive layer being bonded to a layer of kraft paper and the side of the plastic opposite its interactive layer having a temperature resistant adhesive applied thereto. When fabricated into a three-dimensional package, the adhesive is intended to prevent opening of the package along the seams when the adhesive is employed. In other words, it is principally intended that the seam remain intact and that the "hot tack" of the adhesive be sufficiently high to overcome any tendency for the seam to open. While it is planned that one or both ends of the package be severed to open them, it is recognized that the thermoplastic adhesive could have such a poor "hot tack" that either or both ends of the package could be made to open during the microwave heating period. Such an opening technique, not being correlated with heat, time and pressure, renders the package unsuitable for popping popcorn. Also, inasmuch as the interactive or susceptor layer encompasses the entire food item, typically meat pie, sausage roll, pizza or the like, the heat generated by that portion of the interactive layer that overlies the food item would produce scorching of the popped kernels if used to pop popcorn, a result totally unacceptable to the consumer of popcorn.

Hence, a need exists for a package that includes a flexible pouch and encompassing enclosure in which the pouch is contained, the pouch possessing a self-opening capability so that at least some of a food product within the pouch is released into the encompassing enclosure when the package is sufficiently heated in a microwave oven.

SUMMARY OF THE INVENTION

An object of our invention is to provide a self-opening flexible pouch in which a food product is contained, the pouch opening when subjected to a sufficient cooking heat to release at least some of the food product.

More specifically, an aim of the invention is to release the food product into an encompassing enclosure. The invention contemplates that the pouch be fabricated from a plastic film having a layer of paper laminated thereto, and that the encompassing enclosure be in the form of a paper bag of sufficient size to accommodate the released product. The preferred product is popcorn. In this way, the user avoids having to open manually the relatively hot pouch, the consumer only having to open the relatively cool outer bag in order to gain access to the popped contents.

Another object is to provide a low-cost technique for fabricating the flexible pouches.

Yet another object of the invention is to provide a flexible pouch of laminated plastic and paper material in which solid or liquid shortening can be contained for aiding in the effective popping of popcorn. Also, it is within the contemplation of the invention to rely on the plastic material for preserving the contents of the pouch, thereby avoiding the need for wrapping the pouch with additional material. However, it is an aim of the invention to market the flexible pouch in an enclosure in the form of a paper bag which serves the dual purpose of further prolonging the shelf life of the overall product and later functioning to accommodate the popped popcorn that is released from the pouch when it opens.

Briefly, our invention envisages a film of plastic material laminated to a substrate of kraft paper. The plastic film has a central strip of microwave coupling or susceptor material coated on one side thereof, this being the side facing the kraft paper. Also, a marginal strip of microwave coupling or susceptor material is similarly coated on the film, being laterally spaced from the central strip so as to leave an uncoated strip therebetween. The exposed side of the plastic film is coated with a suitable thermoplastic adhesive, and the exposed side of the paper is similarly coated with a thermoplastic adhesive. Thus, the stock thus formed includes a plastic film having the two strips of microwave coupling or susceptor material thereon, and the kraft paper which is laminated to one side of the plastic film and overlies the central and marginal strips thereon. Additionally, the stock includes the two layers of adhesive, a thermoplastic adhesive layer being coated on the exposed side of the plastic film and a water-based adhesive layer securing the film to the paper substrate.

The laminated sheet stock, as described above, is initially wound in the form of a roll. As the laminated stock is drawn or unwound from the roll, it is first folded into an envelope or trough-like configuration by a forming mechanism. During the forming process, a quantity of popcorn kernels (and whatever other ingredients are to be included) is funneled into the folded configuration as the envelope or trough is longitudinally sealed along marginal portions thereof. A transverse sealing of the bottom of the envelope or trough-like configuration just formed and a second transverse sealing therebelow closes the top of the preceding or previously formed pouch, thereby completing the closing of the preceding pouch. The preceding pouch, which has been filled and sealed, is then severed between the two transverse seals and permitted to fall freely onto a conveyor therebeneath. Thus, the pouches are successively severed or cut from the laminated stock to provide a series of filled pouches which are deposited on a conveyor. Each pouch is then placed in an enclosure constituting a paper bag, the paper bag being of a size so as to accommodate whatever popped popcorn is contained in the pouch that is released into the encompassing bag by reason of the self-opening of the pouch at the appropriate time.

It can be pointed out that each pouch that is formed has a main metalized susceptor or microwave interactive panel resulting from the severing of the laminated sheet stock after it has been formed into an envelope or trough configuration. This susceptor panel is located at the bottom of the pouch when the pouch is subsequently placed in a microwave oven by the consumer. Owing to the laminated construction of the pouch, the actual bottom of the pouch when in a microwave oven is the layer of paper, the plastic film residing thereabove with the metalized susceptor or microwave interactive panel sandwiched between the film and the underlying paper. The panels of plastic film to either side of the metalized bottom panel form unmetalized upper panels during the heating cycle, these panels overlying popcorn kernels to be popped and the underlying bottom metalized panel so that microwave energy will be transmitted downwardly therethrough. The unmetalized panels, of course, derive from the uncoated strip residing between the central and marginal strips of susceptor material that have been deposited on the plastic film.

The marginal metalized strip, it can be explained, provides a second susceptor component and confronts a correspondingly located unmetalized marginal strip, being secured thereto by the thermoplastic adhesive that overlies each side of the laminated sheet stock. The heat generated by the second susceptor component causes the pouch to open in this heat-sealed region. It will be recalled that the envelope or trough has its marginal edges sealed together at the time the popcorn kernels are being added. In other words, it is these marginal edges that separate during the heating cycle to open the pouch and release the popped popcorn. The sealed end portions of the pouch also separate.

BRIEF DESCRIPTION OF THE DRAWINGS

FIG. 15 is a perspective view of a paper bag containing therein one of our pouches; and FIG. 16 is an enlarged sectional view taken in the direction of line 16—16 of FIG. 15 but with the popping cycle having been completed and the popped popcorn released into the interior of the encompassing paper bag.

DESCRIPTION OF THE PREFERRED EMBODIMENT

Figure 1:
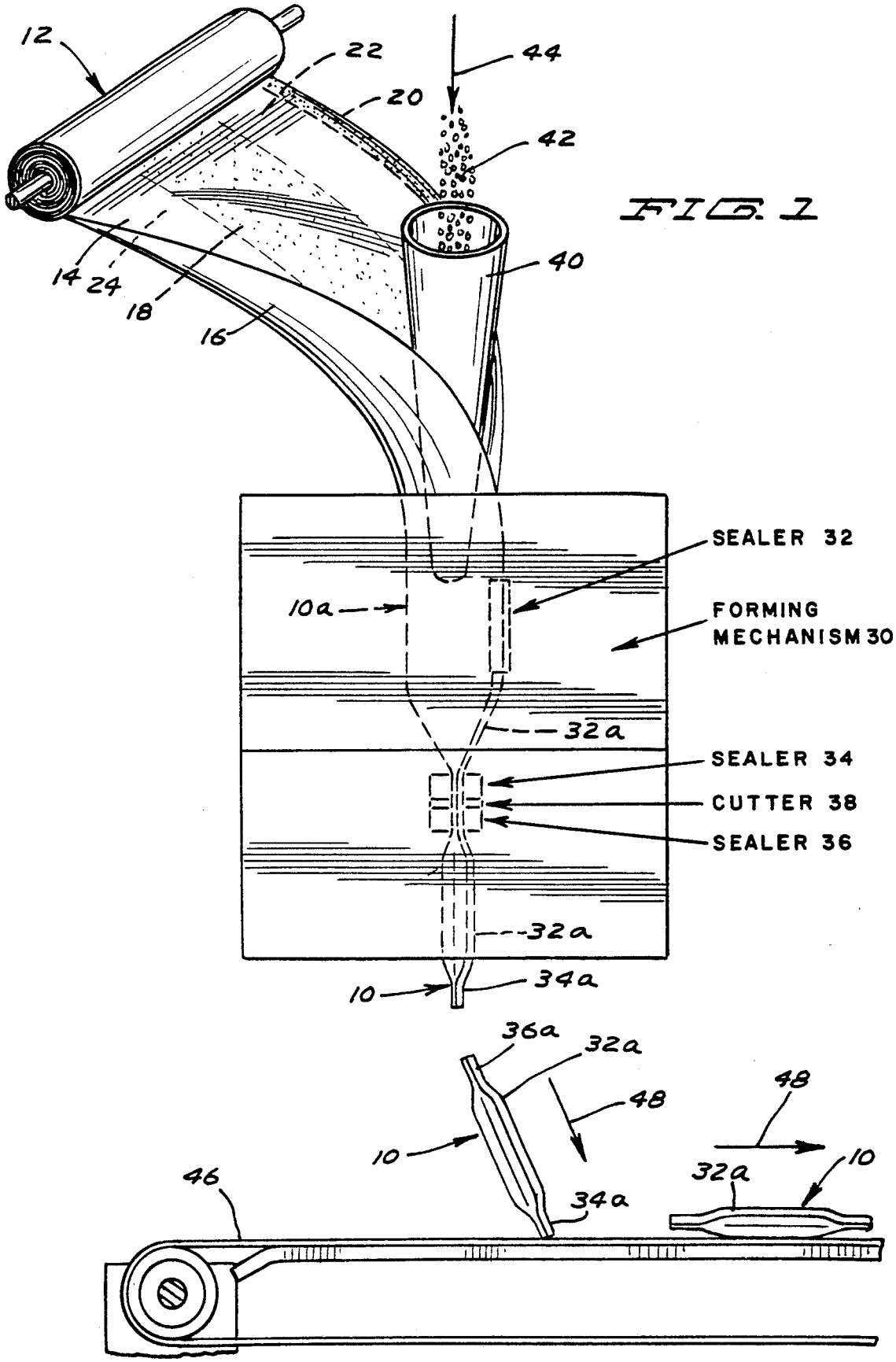
FIG. 1 is a combined perspective and front elevational view of illustrative apparatus for fabricating and filling flexible pouches in accordance with our invention.

Referring first to FIG. 1, the laminated sheet stock from which my pouch 10 can be fabricated has been denoted generally by the reference numeral 12. More specifically, the sheet stock 12 comprises a thin polyester sheet or strip of film 14 laminated to a substrate or backing sheet 16 of 60 pound kraft paper, the film 14 preferably being 48 gauge PET. A central strip 18 of suitable microwave coupling or interactive heat-generating material has been previously applied as a thin coating to the lower side of the film 14, utilizing a conventional sputtering or evaporating technique so that the strip 18 possesses an optical density on the order of 0.028. Similarly, a marginal strip 20 of the same microwave interactive material as the central strip 18 has been previously applied. It should be understood that the coated strips 18 and 20 reside between the overlying plastic film 14 and the underlying paper 16, as viewed in the upper portion of FIG. 1; this accounts for the broken lead lines applied to the reference numerals 18 and 20.

It may be helpful to consider that the roll stock 12 has a width of 13 inches, that the central strip 18 has a width of 5.5 inches, and that the marginal strip 20 has a width of 1.0 inch. Where such dimensions are selected, it results, in actual practice, that the central location of the strip 18 produces an unmetalized strip 22 residing between the metalized strips 18 and 20, this strip 22 having a width of 3.00 inches, and a second unmetalized strip 24 of 3.75 inches. Obviously, the length of the resulting pouch 10 is susceptible to specific selection. It will be assumed, though, for the sake of discussion that the pouch 10 is to have a length of seven inches.

Figure 14:
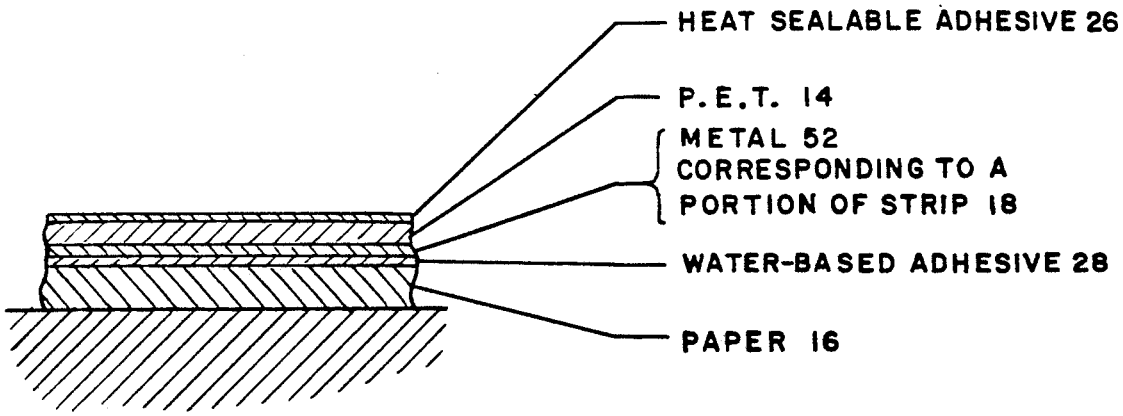
FIG. 14 is a greatly enlarged sectional detail taken in the direction of line 14—14 of FIG. 6 for the purpose of showing to better advantage the laminated construction of my flexible pouch, the view including the two layers of thermoplastic adhesive that have been omitted from FIG. 6 for reasons of simplicity.

The laminated sheet stock 12 in addition to the metalized strips 18 and 20 located on the lower side of the plastic film 14 has a coating or layer 26 of thermoplastic adhesive on its upper side, as viewed in FIG. 1. Similarly, the paper 16 has a layer or coating 28 of water-based adhesive on its upper side which laminates the paper 16 to the under side of the film 14. To show the adhesive layers 26 and 28 in the various views would only complicate the drafting and would serve no real purpose. Nonetheless, it is thought well to depict what constitutes virtually the complete laminated stock 12, doing so in FIG. 14 where the plastic film 14, paper 16, a panel 52 which can be considered to be a portion of the central strip 18 and the adhesive layers 26 and 28 are shown; lacking is any portion of the marginal strip 20 because of its location in the pouch 10. It will be appreciated, though, that the panel 52 has been greatly exaggerated as far as its thickness is concerned in relation to the thickness of the film 14 and the thickness of the underlying paper 16. Likewise, the adhesive coatings or layers 26 and 28 have been greatly exaggerated as far as their thicknesses are concerned. As a practical matter, the layers 18, 26 and 28 have virtually no thickness.

Returning to FIG. 1, a forming mechanism 30 has been denoted generally in block form. As can be understood from this view, the stock 12 as it is drawn from its rolled condition is folded into an envelope or trough-like configuration 10*a*. The marginal portions of the stock 12 are urged into engagement and are heated by a vertically oriented sealer 32 to form a length-wise sealing together of the envelope 10*a* that becomes the pouch 10. There is an upper horizontal or transverse sealer 34 that seals the bottom of the envelope 10*a* being formed by the forming mechanism 30. A lower horizontal or transverse sealer 36 seals the upper end of a preceding envelope 10*a* that results in a completed pouch 10, a cutter 38 severing the lower pouch 10 that has already been completed from the yet to be completed envelope configuration 10*a*.

Attention is now directed to a funnel 40 that delivers a measured quantity or supply of popcorn kernels 42 from an upper hopper (not shown) into the envelope or trough 10*a* that results in the completed pouch 10. The flow of the popcorn kernels 42 is downwardly as indicated by an arrow 44. After sealing by the sealers 32, 34 and 36, the abovementioned severance by the cutter 38 enables the completed pouch 10 to fall gravitationally onto a conveyor 46 therebeneath, the directional movement of the completed pouches 10 for subsequent placement in paper bags (yet to be referred to) being indicated by the arrows 48.

Figure 12:
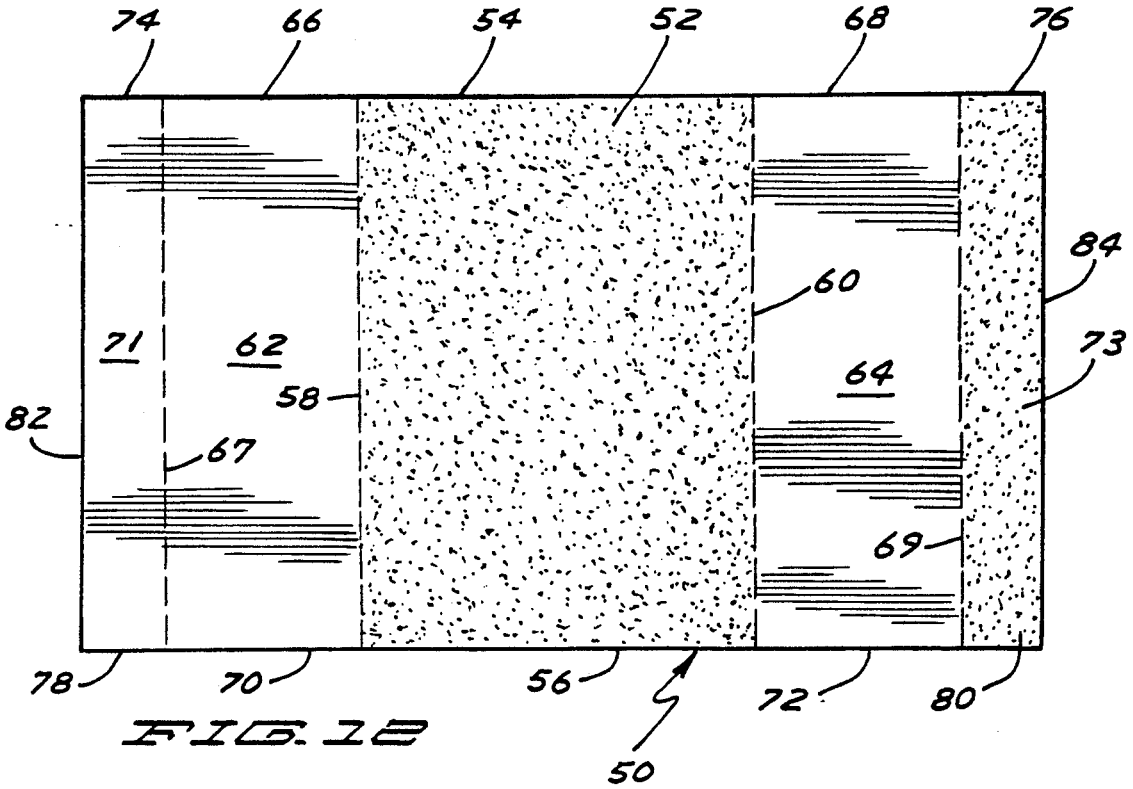
FIG. 12 is a top plan view of what will be termed an individual blank from which our pouch can be made when not fabricated with the apparatus of FIG. 1, the view omitting the paper laminate so as to expose the susceptor material coated thereon with the view having applied thereto various dashed fold lines that will be of assistance in understanding my invention.

Although the completed pouch has been assigned the reference numeral 10 when fabricated by the apparatus of FIG. 1, it will be well, it is believed, to refer at this stage of the description to FIG. 12 where a rectangular flat blank has been indicated generally by the reference numeral 50, the blank 50 possessing the same length (preferably seven inches) that results from the cutting or severing of the sheet stock 12 by the cutter 38 of FIG. 1. It will simplify the ensuing description to omit the paper 16 that would be laminated to the plastic film 14. It will be recalled that the sheet stock 12 in FIG. 1 includes the plastic film 14 and the paper substrate 16, as well as the metalized strips 18 and 20 (and the adhesive layers 26 and 28 of FIG. 14, although these layers 26, 28 do not appear in FIG. 1). Hence, when considering FIGS. 12 and 13, all that the reader need do is appreciate that the paper layer 16, which would overlie (not underlie) what is depicted in these two figures, has been omitted for reasons of simplicity and clarity. Looked at in another way, the blank 50 can be considered to have been produced by the cutter 38 performing its severing action at prescribed lengths (such as seven inch lengths) without any sealing taking place by the sealers 32, 34 and 36 (and of course with the paper 16 omitted as just stated).

While the blank 50 could be fabricated with the apparatus of FIG. 1 by utilizing just the cutter 38, it is somewhat easier to assume that the blank 50 has been individually cut to size but with the susceptor material having been previously applied to the upper side (not the lower side) thereof via the evaporating or sputtering process that is conventional and which is utilized in providing the metalized strips 18 and 20 of FIG. 1. Once again, it is emphasized that for the sake of discussion the blank 50 has been individually cut without any paper layer, such as that labeled 16 in FIG. 1, laminated thereto, thereby facilitating the description that follows.

Figure 13:
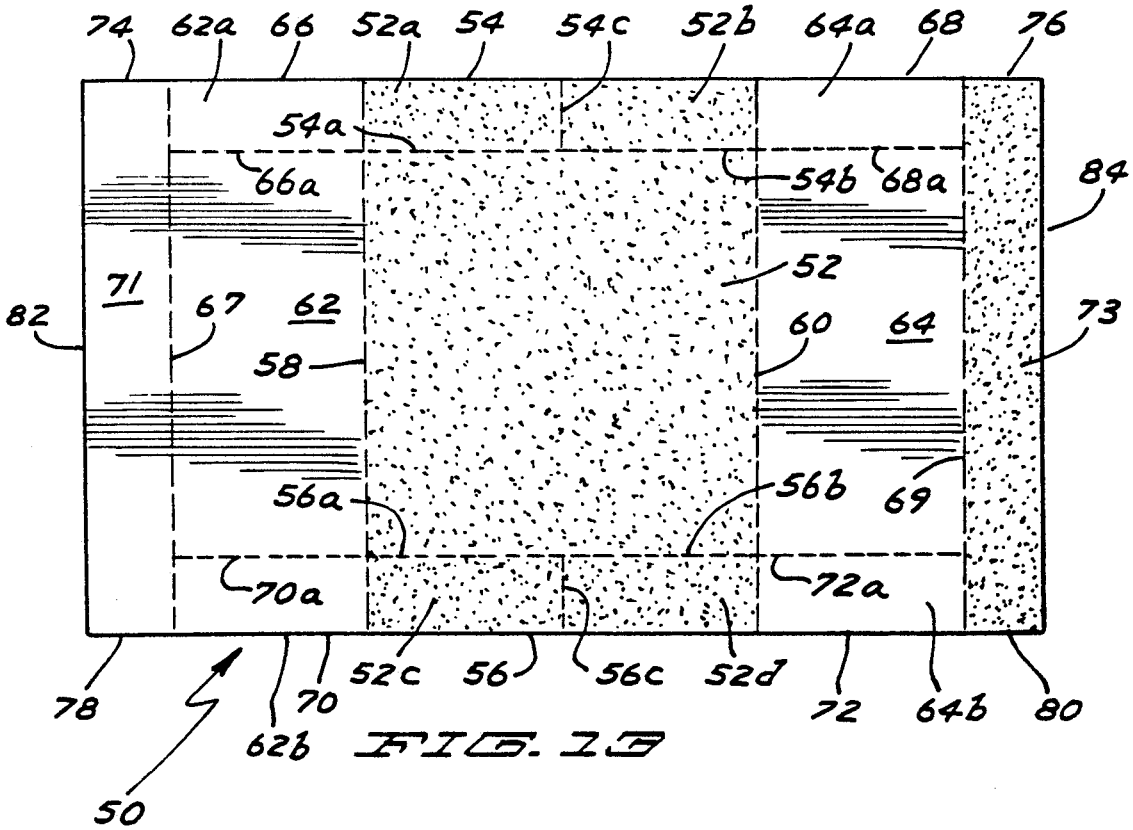
FIG. 13 is a view corresponding to FIG. 12 but with additional dashed lines of shorter length so as to provide an even understanding of FIGS. 5–9.
Figure 25:
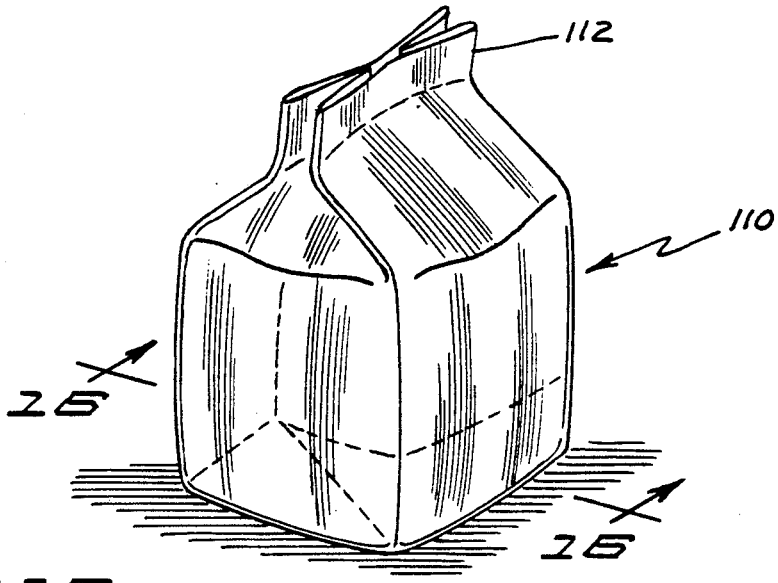
Figure 26:
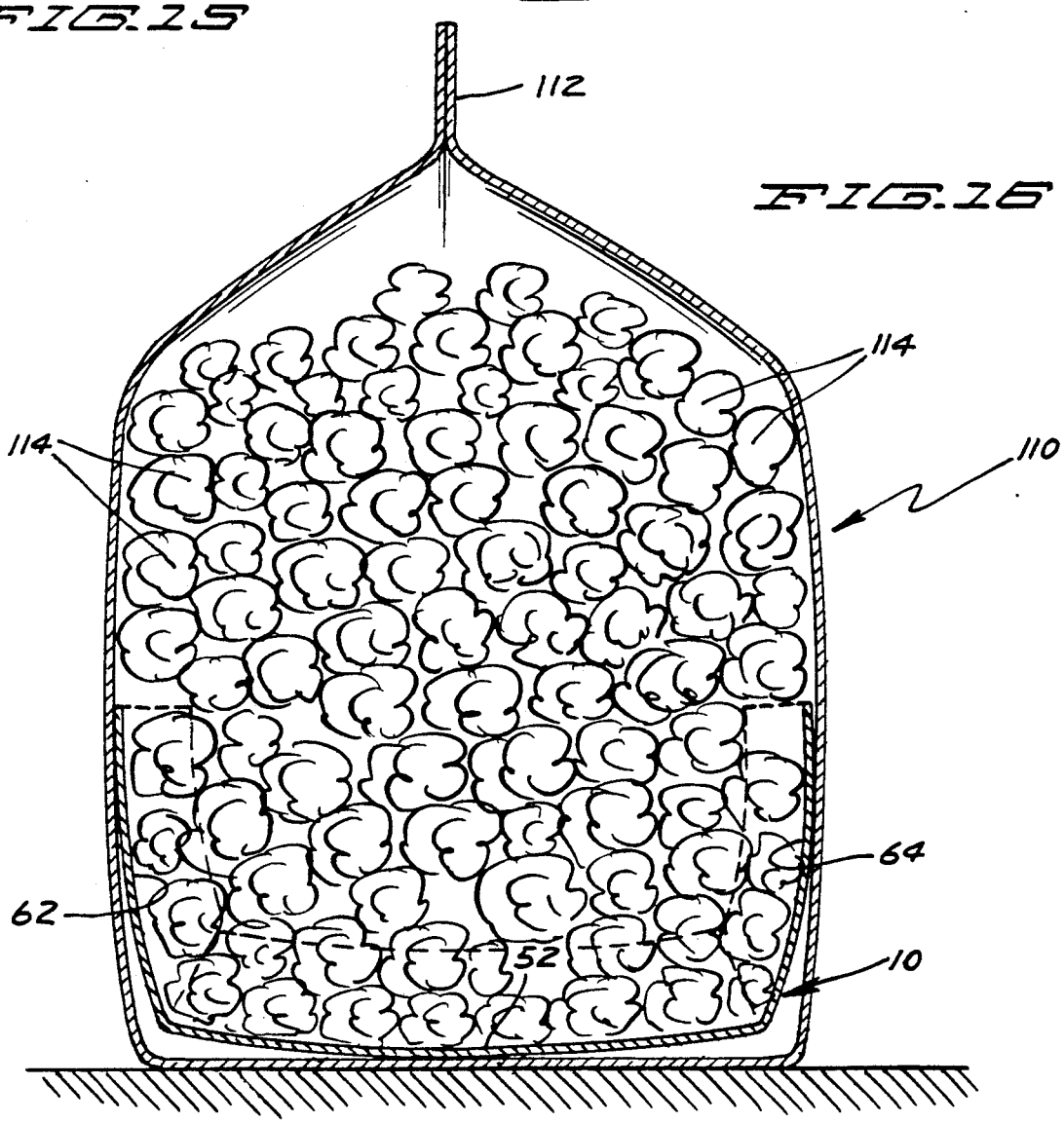

FIG. 12, it can be pointed out, will also be particularly helpful in understanding some of the claims; likewise, FIG. 13 will be of assistance, too. More specifically, it can be explained at this point that FIG. 13 is presented for the purpose of illustrating certain areas, segments or portions that are secured together with a suitable thermoplastic adhesive, such as that represented by the reference numeral 26, the adhesive producing the completely sealed pouch 10.

As far as FIG. 12 is concerned, the blank 50 includes a central panel 52, this panel 52 being completely metalized over its entire surface to provide a relatively large susceptor component in the completed pouch 10. The panel 52, in practice would be derived from the central metalized strip 18, constituting a portion or segment thereof. It will be helpful to consider that the panel 52 has a forward (upper) edge 54, a rear (lower) edge 56, and side edges 58 and 60. The side edges labeled 58 and 60 of the panel 52 correspond to the lines about which the folding performed by the former 30 of FIG. 1 takes place. However, it is easier, it is believed, to consider the lines 58 and 60 as side edges of the panel 52, particularly in comprehending a number of the later-presented claims. Once again, it should be recognized that the panel 52 would result from the cutting of the sheet stock 12 into desired lengths by means of the cutter 38. As far as FIGS. 12 and 13 are concerned, though, and as already mentioned, the blank 50 may be considered to be formed manually, such as by applying or coating the microwave interactive material onto plastic film that has already been pre-cut rather than the sequential procedure exemplified in FIG. 1.

Continuing with the description of the blank 50, there are a number of unmetalized panels 62 and 64 having forward edges 66 and 68, respectively, and rear edges 70 and 72, respectively. Although the side edges actually constitute fold lines, it will be stated for ease of understanding that the panels 62 and 64 have first edges that coincide with the edges or fold lines 58 and 60. Additionally, the panels 62 and 64 have side edges 67 and 69, respectively. Stated somewhat differently, the edge 58 is integral wit both panels 52 and 62, and the edge 60 is integral with both panels 52 and 64. Thus, the panels 62 and 64 are integrally attached or secured to the panel 52.

Reference will now be made to a pair of marginal panels 71 and 73, the panel 73 being unmetalized and the panel 72 metalized, that is, coated with susceptor or microwave interactive material. The panel 73 corresponds to a segment, preferably seven inches in length, of the marginally located metalized strip 20. The panel 71 has a forward edge 74 and the panel 73 has a forward edge 76. The panels 71 and 73 have rear edges 78 and 80, respectively. The panel 71 has a first side edge that coincides with the edge 67 so that the panel 71 is actually integral with the panel 62. Similarly, the panel 73 has a first side edge that coincides with the edge or fold line 69. Additionally, the panels 71 and 73 have second side edges 82 and 84, respectively.

FIG. 13, as already mentioned, is an extension of FIG. 12. Hence, the same "edges" that have been identified when describing FIG. 12 have been given the same reference numerals in FIG. 13. However, in folding the blank 50 of FIG. 12 so as to form the completed pouch 10 appearing in FIGS. 5–9, the back sides of certain segments or portions of the panels 52, 62 and 64 are brought into contact, actually their adhesively coated surfaces, with each other and these engaging segments or portions are heat sealed together. Therefore, in an effort to make the construction of the pouch 10 as understandable as possible when employing the blank 50, additional "lines" have been, in effect, superimposed on FIG. 12 to produce FIG. 13. In this regard, it will be noted that lines 54*a*, 54*b* and 54*c* composed of somewhat shorter dashes have been applied so that portions or segments 52*a* and 52*b* are provided. Similarly, lines 56*a*, 56*b* and 56*c* also composed of shorter dashes form segments or portions 52*c* and 52*d*. The portions or segments 52*a*, 52*b*, 52*c* and 52*d* are metalized inasmuch as they are subdivisions of the overall metalized panel 52.

Continuing with the description of FIG. 13, it should be noted that a dashed line 66*a* forms an unmetalized portion or segment 62*a* and a dashed line 70*a* similarly forms an unmetalized portion or segment 62*b*. Likewise, a dashed line 68*a* provides an unmetalized portion or segment 64*a*, whereas a dashed line 72*a* forms an unmetalized portion or segment 64*b*.

In fabricating the pouch 10 from the blank 50, what develops into the panel 62 is folded about the edge 58 to become one upper panel devoid of susceptor material. Such a folding procedure causes the back side of the portion or segment 62*b* to engage the back side of the portion or segment 52*c* and the portion or segment 64*b* to engage the portion or segment 52*d*. By applying heat to the adhesively coated portions or segments 52*c*, 52*d*, 62*b* and 64*b*, the portions or segments 62*b*, 64*b* are firmly secured to the portions 52*c*, 52*d*. Once again, it should be recognized that the paper corresponding to the paper 16 has been omitted from FIGS. 12 and 13, along with the adhesive layers 26 and 28. By means of heat applied to the portions 52*a*, 52*b*, 62*a*, 64*a*, the portions 52*a*, 62*a* are heat sealed together and the portions 52*b*, 64*a* are similarly secured to each other.

It should be recognized that the vertically oriented sealer 32 associated with the forming mechanism 30 shown in FIG. 1 would correspondingly fold the panel 71 about the edge or fold line 67 and concomitantly fold the panel 73 about the edge or fold line 69, and that the sealer 32 would correspondingly heat seal the panels 71 and 73 together by reason of the heat supplied by this sealer 32.

It is important to note that the panels 71 and 73 do not overlap; instead they merely confront each other and will release or open readily at the appropriate time during the popping cycle by virtue of the heat generated by the metalized panel 73 that functions as a secondary susceptor component of reduced dimensions as compared with the primary susceptor component constituting the metalized lower panel 52. Of course, it is the susceptor component in the form of the metalized panel 52 that heats the kernels 42 contained in the pouch 10, the metalized panel 73 functioning solely as a secondary susceptor component for effecting the release or disengagement of the panels 71 and 73 at the appropriate time after the pouch 10 has been subjected to a sufficient amount of microwave energy supplied by a conventional microwave oven. It will be appreciated that the amount of heat generated by the microwave coupling or susceptor action provided by the metalized panel 73 provides a sufficient amount of heat when correlated with the type of thermoplastic adhesive, such as that labeled 26 in FIG. 14, so that the pouch 10 will open at an optimum time when subjected to microwave energy supplied by a microwave oven, such a time being that that popcorn kernels 42 have been fully popped and when the escape of pent-up vapors should be released from the pouch 10.

Figure 7:
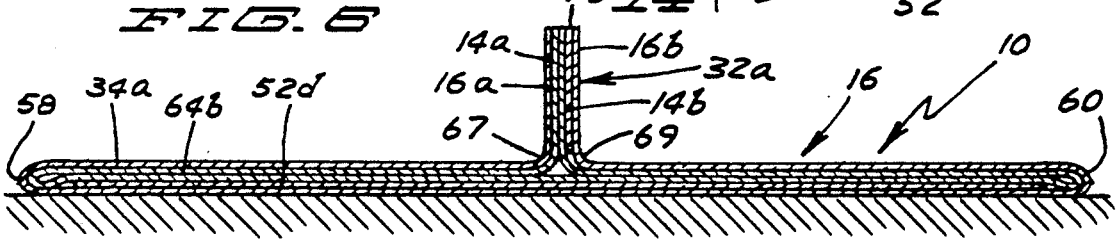
FIG. 7 is a sectional view taken in the direction of line 7—7 of FIG. 5 showing how one end of the pouch is sealed.
Figure 8:
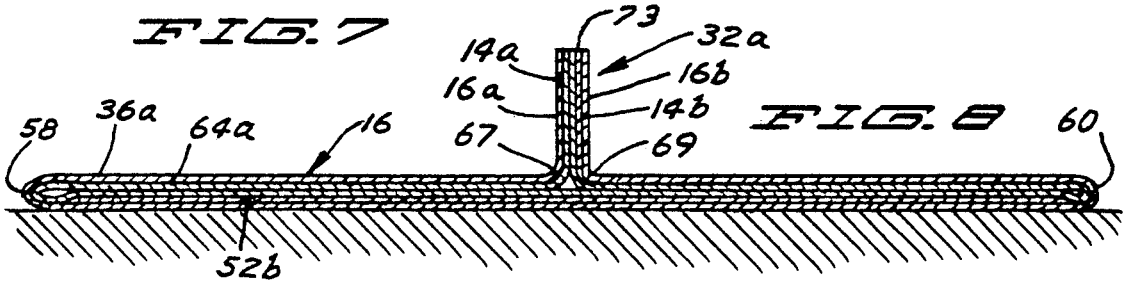
FIG. 8 is a view taken in the direction of line 8—8 of FIG. 5 to show that the other end of the pouch is sealed closed in the same manner as the end appearing in FIG. 7.
Figure 9:
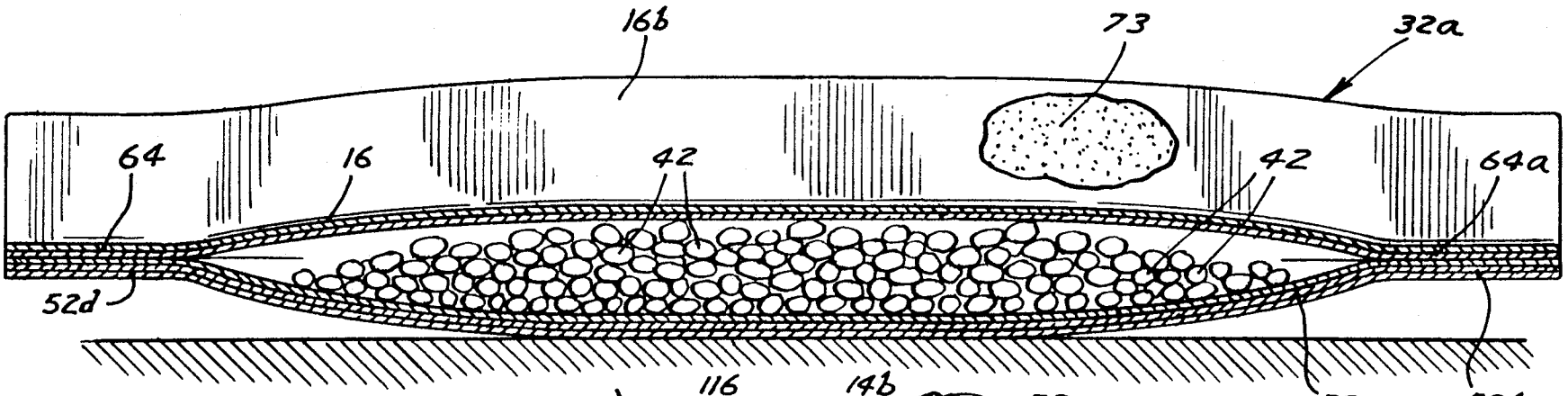
FIG. 9 is a greatly enlarged longitudinal sectional view taken in the direction of line 9—9 of FIG. 5.

The closed end portions or seams 34*a* and 36*a* of the pouch 10, as shown in FIGS. 7 and 8, also open. However, these end portions or seams 34*a* and 36*a* receive somewhat less microwave energy and open a short interval of time after the panels 71 and 73 have separated.

It will be recognized that the pouch 10 is truly a self-opening one, the opening being realized during a dwell time determined by heat, time and pressure. Recapitulating somewhat, heat is generated by the panel 73, as far as the central portion of the pouch 10 is concerned, and by the portions of the panel 52 adjacent the ends of the pouch 10. The time taken to effect a complete release of the several seams can be determined by the particular type of thermo-plastic adhesive that is selected. Additionally, the build-up of vapor pressure within the pouch 10 and the pressural action or expansive force of the kernels 42 as they pop cumulatively contribute to the optimum opening of the pouch 10.

Having prefaced the description of our pouch 10 by first referring to FIG. 1 followed by a description of FIGS. 12 and 13, it is thought that a detailed description now to be given with respect to FIGS. 5–9 will be better understood. At the outset it will be observed that the laminated paper layer 16 is included in these views. However, no need is seen to exist for showing either adhesive layer 26 or 28, which appear in FIG. 14; besides these layers 26 and 28 are really coatings, possessing no discernible thickness. An effort will be made, however, to correlate what is produced through the agency of the apparatus of FIG. 1 and what results from the blank 50 of FIGS. 12 and 13.

Figure 5:
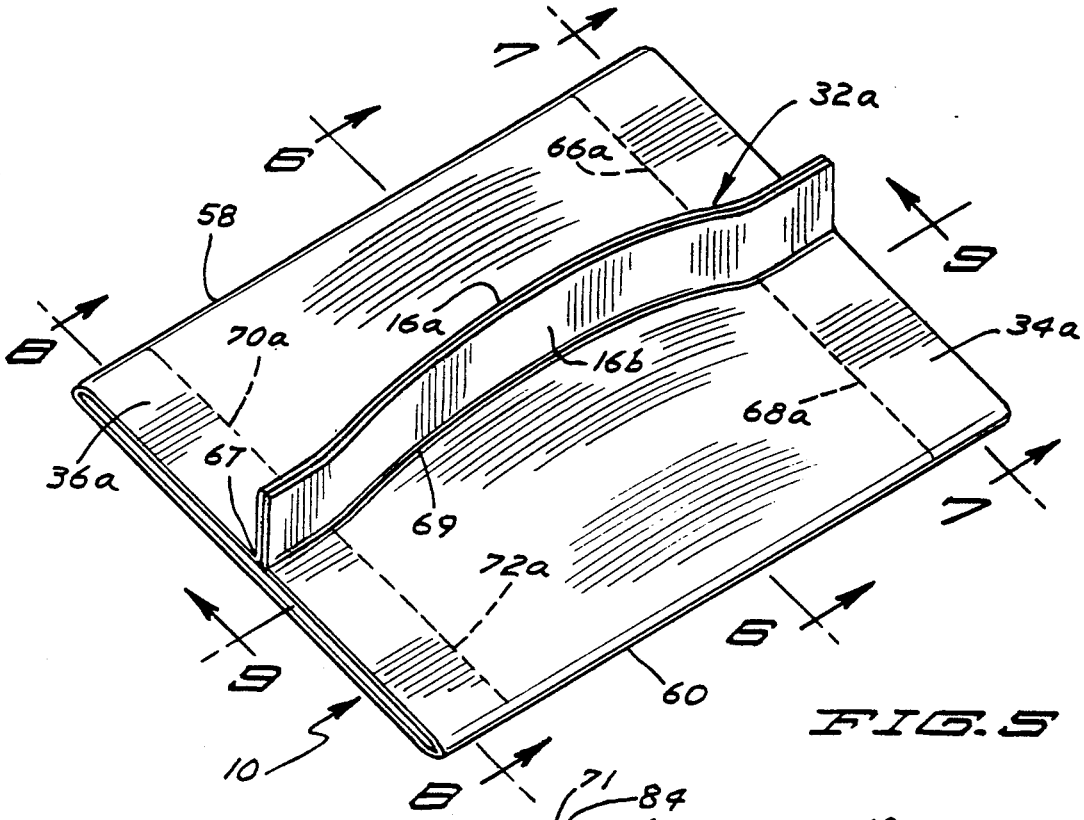
FIG. 5 is a perspective view of a completed pouch, the seam that has been formed by the longitudinal sealing of the marginal edges in FIG. 1 being shown in an upstanding relationship in order to make the overall construction of the pouch more readily understandable.
Figure 6:
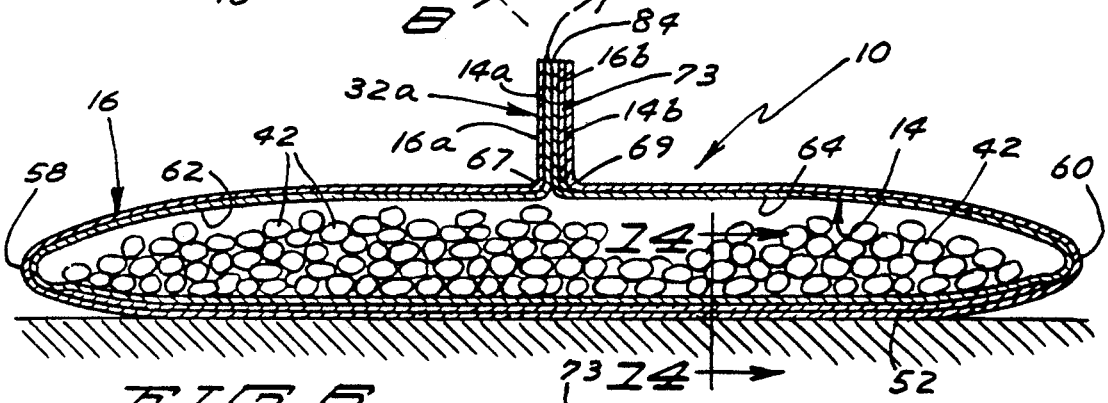
FIG. 6 is a transverse sectional view, somewhat enlarged, taken in the direction of line 6—6 of FIG. 5.

It will be recalled that the sealer 32 of FIG. 1 longitudinally seals the envelope 10*a* forming what will now be referred to as a seal or seam 32*a* composed of plastic flanges 14*a* and 14*b* and paper flanges 16*a* and 16*b*, and so labeled in FIGS. 6–8 (and to some degree in FIG. 5). It should be understood, though, that the seal or seam 32*a* lies flat, that is, generally parallel to the plane of the pouch 10 when leaving the sealer 32, whereas it is shown generally perpendicular to the plane of the pouch in FIGS. 5–9. Only a glance at FIGS. 6–8 should suffice to demonstrate that the exaggerated thicknesses of the laminations in these figures does not permit a showing of the parallel relationships; this accounts for the perpendicularity of the seam 32*a* in FIGS. 5–9. Whereas the sealer 32 forms the central seal or seam 32*a*, the sealers 34 and 36 form the end seals or seams 34*a* and 36*a*.

Figure 2:
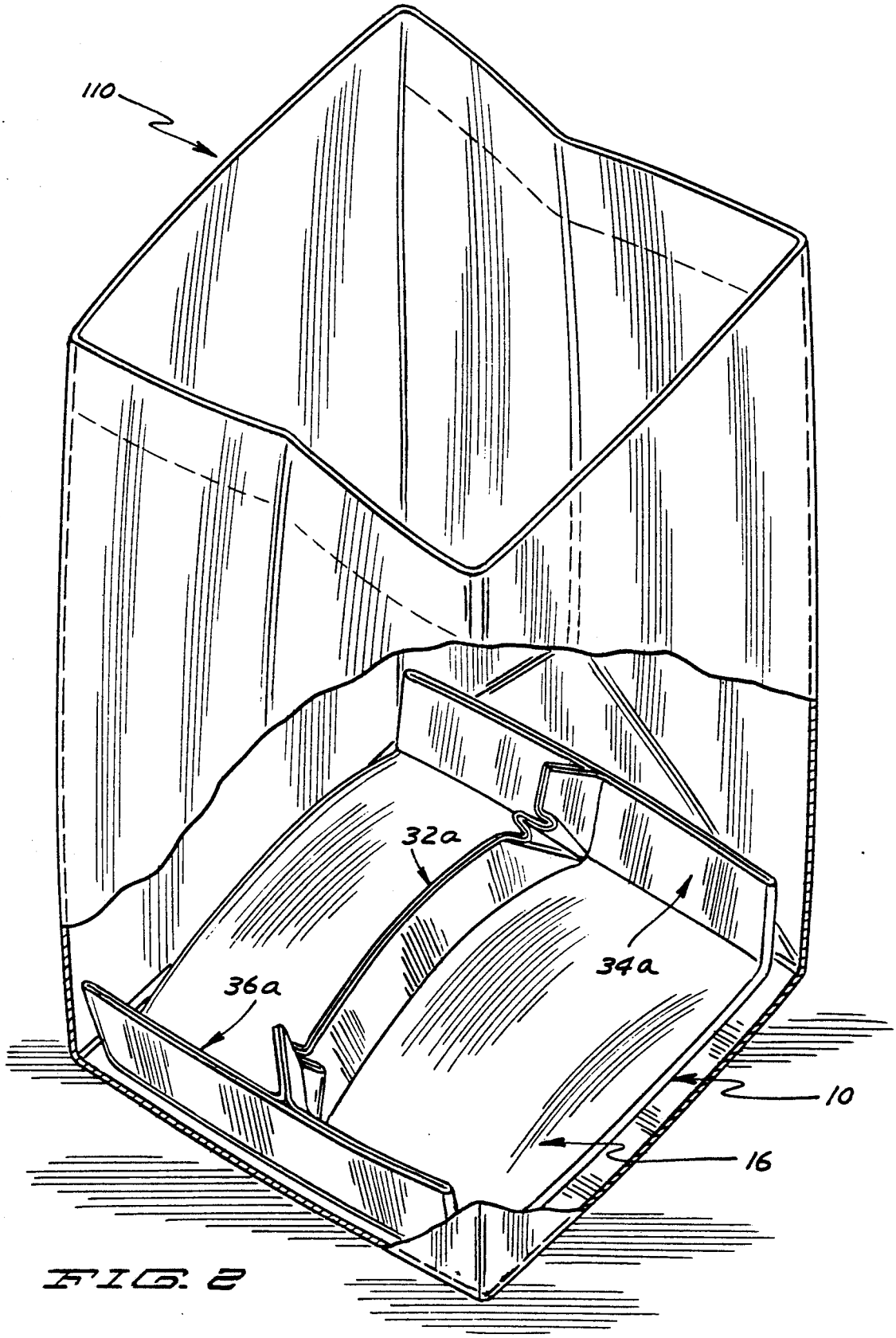
FIG. 2 is a perspective view of a paper bag containing therein one of our flexible pouches, a considerable portion of the bag having been broken away so as to expose the otherwise concealed pouch to view.

It is intended that the flexible pouch 10 with its kernels 42 be marketed in an enclosure in the form of a paper bag 110. Such a bag 110 appears in FIG. 2, and also in FIGS. 15 and 16, the bag having its upper end closed as indicated by the reference numeral 112. FIG. 2 depicts the pouch 10 within the bag 110, this being the way in which the pouch 10 and bag 110 are intended to be marketed. In other words, the pouch 10, as it appears in FIG. 2, represents the pouch 10 in an unheated condition, such a condition corresponding to the condition of the pouch 10 as it appears in FIGS. 5–9.

FIG. 16 is a sectional view through the bag 110, the view showing the condition of the pouch 10 after the kernels 42 have been completely popped by microwave energy supplied by a microwave oven. The popped popcorn has been denoted by the reference numeral 114 in FIG. 16. Obviously, the laminated structure of the pouch 10 is not illustrated in this view, such a showing being unnecessary in view of FIGS. 5–9.

Figure 11:
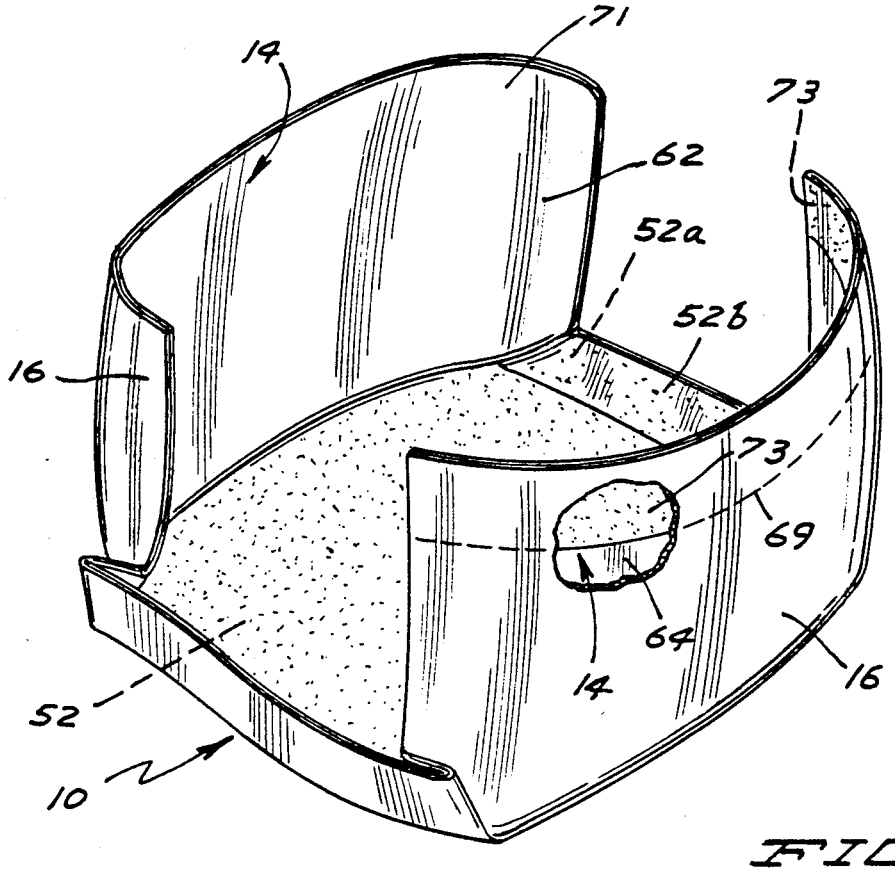
FIG. 11 is a perspective view of the pouch also without the encompassing paper bag, the pouch being completely open but with the popped popcorn having been omitted.

It is believed that the view shown in FIG. 11 of the fully opened pouch 10 without the popped popcorn 114 and without the encompassing bag 110 will be of help in further appreciating the benefits to be derived from a practicing of our invention. Here again, it is not believed necessary to show the laminated construction of the pouch 10 in that reference may be had to FIGS. 5–9 for an understanding of the pouch's structure. It should be apparent from FIG. 11, however, that the consumer need only open the top 112 of the bag 110 to gain access to the popped popcorn 114 of FIG. 16. In other words, once the top 112 has been opened, the popped popcorn 114 is readily accessible to the consumer. It should be taken into account that the bag 110, being of paper, remains relatively cool, whereas the pouch 10, owing to the susceptor material that is involved, is relatively hot. Consequently, the user does not have to touch the hot pouch 10 and does not experience any discomfort because the popcorn 114 becomes readily accessible by reason of the automatic opening of the pouch 10 that occurs within the bag 110.

Figure 10:
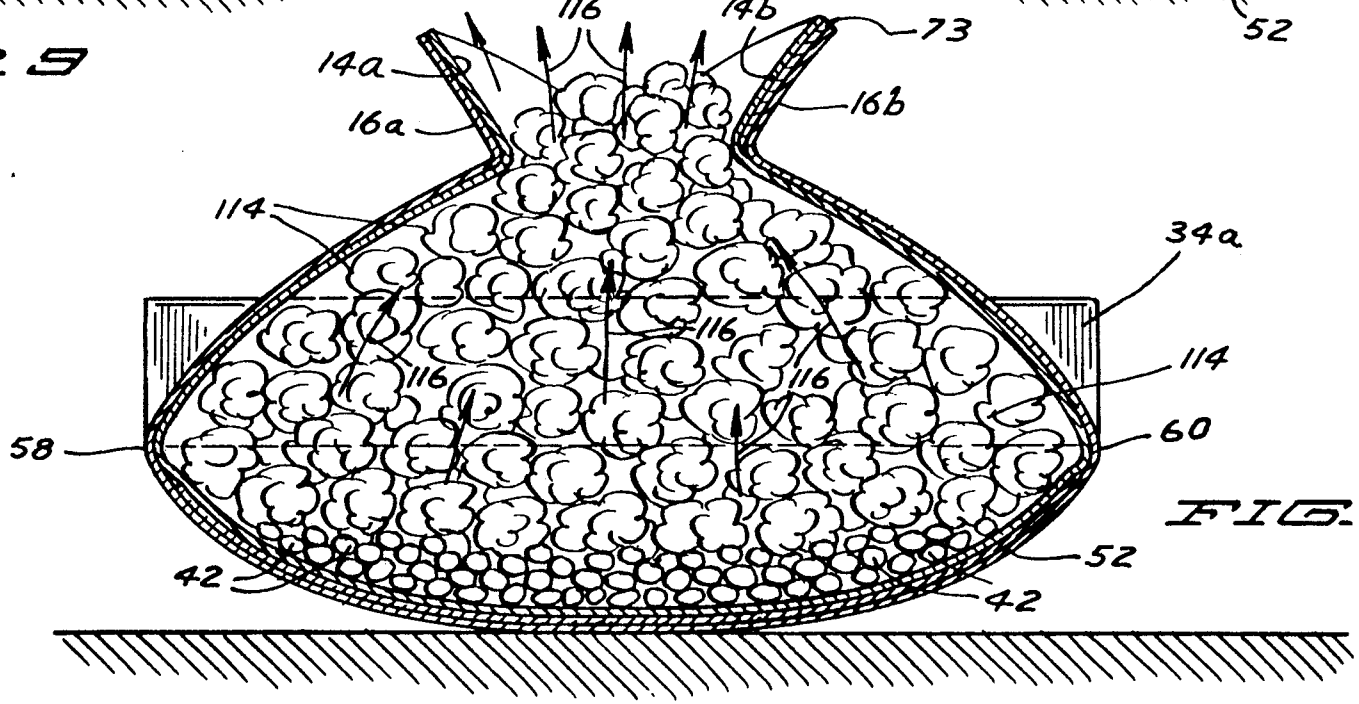
FIG. 10 is a sectional view taken generally in the same direction as FIG. 6, but picturing the flexible pouch as it opens during a popping cycle, the encompassing bag of FIG. 2 having been omitted from this view for simplicity reasons.

Possibly FIG. 10 will be of still additional help in more fully recognizing the advantages of our invention. FIG. 10 is a sectional view through the pouch 10 just as it begins to open by reason of the automatic release effected by the auxiliary susceptor panel 73. The fewer kernels 42 at the bottom in FIG. 10 remain unpopped at this particular point, but most of the kernels 42 have become popped and are indicated by the reference numeral 114 used when describing FIG. 16. The various arrows 116 applied to FIG. 10 indicate the build-up of pressure within the pouch 10. It is this vapor pressure and the expansion of the kernels 42 that contribute to the opening shown in FIG. 10. It will be appreciated that the opening, as illustrated in FIG. 10, not only releases the popped kernels 114 into the bag 110 (which has not been depicted in this particular figure), but also releases the pent-up vapors at the appropriate time. The thermoplastic adhesive layer 26, indicated only in FIG. 14, also softens and it is the concerted action of the vapor pressure, the expansion of the kernels 42 and the softening of the adhesive material 26 that first causes the opening as illustrated in FIG. 10, this being the separation of the seam 32*a*, plastic flanges 14*a* and 14*b*, from each other. Shortly thereafter, the end portions of the pouch 10 release and the tulip-like configuration of the pouch 10 pictorially presented in FIG. 11 results.

One nicety about the pouch 10 is that when sealed in the various areas that have been identified, a liquid-proof pouch results so that either solid or liquid shortening can be included with the kernels 42 that are to be popped. Such an ingredient contributes to the vapor pressure that assists in the opening of the pouch 10 in the manner just described. Moreover, inasmuch as the plastic film 14 is utilized, the shelf-life of the contents of the pouch 10 is better preserved. Actually, when packaging the pouch 10, it need not be enwrapped with any overlay.

Figure 3:
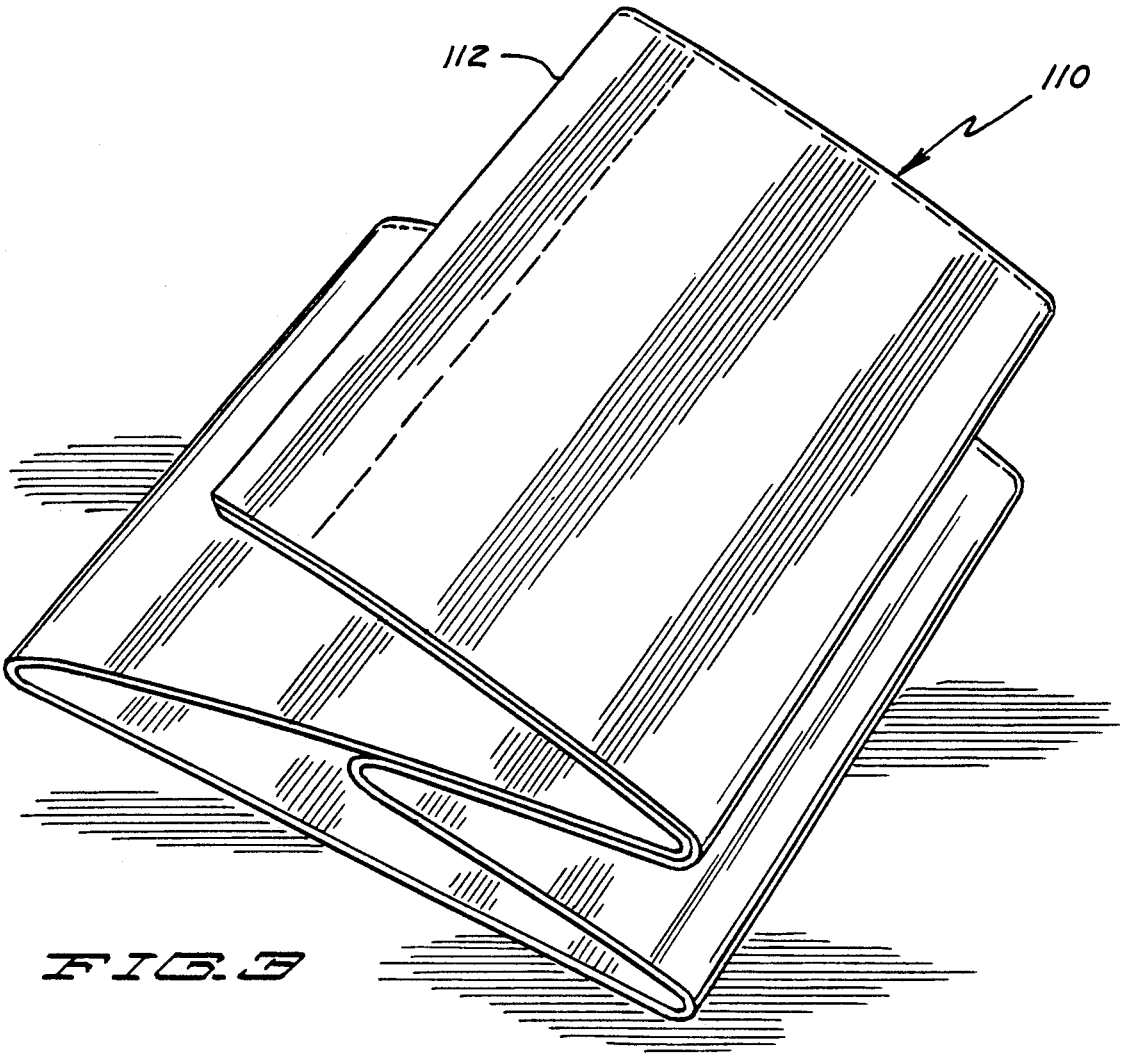
FIG. 3 is a perspective view of a paper bag containing my pouch (not visible) therein, the bag being in the process of being folded.
Figure 4:
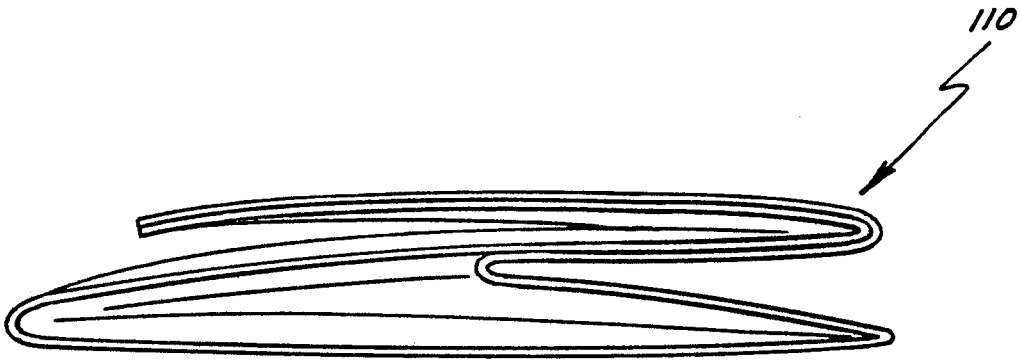
FIG. 4 is an end view of FIG. 3 with the bag being completely folded, the, folded condition being that which it assumes when being packaged with other pouches.

Once placed in the paper bag 110, the pouch 10 and the paper bag 110 become a unit and are intended to be marketed in such a relationship. Hence, from FIG. 3, it will be discerned that the combination of the paper bag 110 and the pouch 10 therewithin (but not visible) can be readily compacted by folding, FIG. 3 indicating the folding procedure as it progresses, whereas FIG. 4 denotes the completely folded and compacted paper bag 110 with the pouch 10 contained therein.

We claim:

1. A flexible pouch for use in cooking food in a microwave oven comprising a lower panel having opposite edges, a pair of upper panels integral with the opposite edges of the lower panel and overlying said lower panel, with the pair of upper panels having opposite edges, a marginal panel integral with the opposite edge of each upper panel, said marginal panels being secured to each other in a face-to-face relation to form a seam, a susceptor component on said bottom panel for generating cooking heat, and a second susceptor component between said marginal panels for generating heat to release the securement of said marginal panel portions to open said seam along its entire length and said pouch and release the food from the pouch.

2. A pouch in accordance with claim 1 in which said second susceptor component is coextensive with one of said marginal panels.

3. A pouch in accordance with claim 1 further comprising means for enclosing the food with the release of the securement of said marginal panel portions.

4. A flexible pouch for use in microwave cooking comprising a lower panel having opposite edges, a pair of upper panels connected to the opposite edges of the lower panel and having opposite edges, and a pair of marginal panels connected to the opposite edges of the pair of upper panels, said marginal panels being secured together to provide an upper seam and portions of said lower and upper panels being secured together to provide forward and rear seams, and at least a portion of one of said marginal panels is metalized to provide a susceptor component for supplying heat for causing said upper seam to open along its entire length.

5. A pouch in accordance with claim 4 in which at least a portion of said lower panel is metalized to provide a susceptor component for supplying cooking heat.

6. A pouch in accordance with claim 5 in which the metalized portion of the lower panel includes portions in the forward and rear seams for supplying heat for causing said forward and rear seams to open.

7. A pouch in accordance with claim 6 in which the metalized portions of the marginal panel and of the lower panel are in the form of strips.

8. A pouch in accordance with claim 7 wherein the panels are fabricated from a layer of thin plastic film laminated to a layer of paper, with the metalized portions being between the plastic film layer and the paper layer.

9. A flexible pouch of plastic film and a sheet of paper laminated thereto for use in cooking food in a microwave oven comprising a lower rectangular panel having forward, rear, and first and second laterally spaced side edges, a pair of upper rectangular panels each having forward, rear, and first and second laterally spaced side edges, the first side edge of one of said upper panels being integral with the first side edge of said lower panel and the first side edge of the other of said upper panels being integral with the second side edge of said lower panel, a pair of marginal panels each having forward, rear, and first and second laterally spaced side edges, the first side edge of one of said marginal panels being integral with the second side edge of said one upper panel and the first side edge of the other of said marginal panels being integral with the second side edge of the other of said upper panels, at least portions of said marginal panels being secured to each other to retain their said second side edges in substantial registry with each other to provide an upper seal, at least a portion of said lower panel adjacent its said forward edge being secured to at least portions of the upper panels adjacent their said forward edges to provide a forward seal, at least a portion of said lower panel adjacent its said rear edge being secured to at least portions of the upper panels adjacent their said rear edges to provide a rear seal, at least a portion of said lower panel being metalized to provide a first susceptor component for generating cooking heat, and at least a portion of said one marginal panel is metalized to provide a second susceptor component for supplying heat for causing the upper seal to open along its entire length and release the food.

10. A pouch in accordance with claim 9 in which said marginal panels are secured to each other by means of a thermoplastic adhesive, said second susceptor component generating sufficient heat to cause separation of said marginal panels to thus cause said pouch to open.

11. A plastic blank for use in fabricating a flexible pouch for use in cooking food in a microwave oven comprising a layer having a forward edge, a rear edge, and first and second side edges; a first strip of microwave coupling material on the layer from the forward edge to the rearward edge, a second strip of microwave coupling material on the layer from the forward edge to the rear edge and extending along the first side edge of said layer and spaced laterally from said first strip, an uncoated area located between said first and second strips, and means on the layer for securing the layer into a trough-like configuration, with the second strip arranged to release the securement means when in the trough-like configuration while cooking food in the microwave oven.

12. A blank in accordance with claim 11 further comprising a second area extending from said first strip to the second side edge of said layer and which is also uncoated, with the securing means securing the second strip to the second area.

13. A blank in accordance with claim 12 wherein the first strip has a constant width from the forward edge to the rear edge, wherein the second strip has a constant width from the forward edge to the rear edge, and wherein the first and second strips are parallel.

14. A blank in accordance with claim 13 wherein the second strip is adjacent and parallel to the first side edge.

15. A plastic pouch for use in cooking food in a microwave oven comprising a first metalized microwave susceptive panel (52) having first and second side edges and including first, second, third and fourth portions (52*a*), (52*b*), (52*c*) and (52*d*), a first unmetalized panel (62) connected to the first side edge of the first metalized microwave susceptive panel, with the first unmetalized panel having a side edge and including first and second portions (62*a*) and (62*b*), a second unmetalized panel (64) connected to the second side edge of the first metalized microwave susceptive panel, with the second unmetalized panel having a side edge and including first and second portions (64*a*) and (64*b*), said first portion (62*a*) of the first unmetalized panel being secured to said first portion (52*a*) of the first metalized microwave susceptive panel, said second portion (62*b*) of the first unmetalized panel being secured to said third portion (52*c*) of the first metalized microwave susceptive panel, said first portion (64*a*) of the second unmetalized panel being secured to said second portion (52*b*) of the first metalized microwave susceptive panel, said second portion (64*b*) of the second unmetalized panel being secured to said fourth portion (52*d*) of the first metalized microwave susceptive panel, a third unmetalized panel (70) connected to the side edge of the first unmetalized panel, and a second metalized microwave susceptive panel (72) connected to the side edge of the second unmetalized panel, said third unmetalized panel (70) being secured to said second metalized microwave susceptive panel (72) to form a seam.

16. A plastic pouch in accordance with claim 15 in which said third unmetalized panel and said second metalized microwave susceptive panel (70) and (72) are secured by means of a thermoplastic adhesive.

* * * * *